United States Patent [19]

Cowan

[11] Patent Number: 4,870,890

[45] Date of Patent: Oct. 3, 1989

[54] AUTOMATIC REVERSING VALVE

[76] Inventor: Philip L. Cowan, 901 Ashland, Houston, Tex. 77008

[21] Appl. No.: 235,045

[22] Filed: Aug. 22, 1988

Related U.S. Application Data

[63] Continuation of Ser. No. 909,594, Sep. 17, 1986, abandoned, which is a continuation-in-part of Ser. No. 776,562, Sep. 16, 1985, abandoned.

[51] Int. Cl.[4] ..... F01L 15/02; F01L 31/00; F01B 25/02

[52] U.S. Cl. ..... 91/50; 91/321; 91/336; 91/342; 91/350; 91/235; 91/417 R

[58] Field of Search ..... 91/395, 410, 417 R, 91/50, 321, 325, 336, 341 R, 342, 350, 235

[56] References Cited

U.S. PATENT DOCUMENTS

| | | | |
|---|---|---|---|
| 2,556,680 | 6/1951 | Davis . | |
| 2,980,079 | 4/1961 | Joelson | 91/321 |
| 3,007,454 | 11/1961 | Joelson | 91/321 |
| 3,183,788 | 5/1965 | Olsson | 91/342 |
| 3,500,753 | 3/1970 | Greene, Jr. | 91/50 X |
| 3,554,086 | 1/1971 | Wills | 91/417 R X |
| 3,618,469 | 11/1971 | Wills et al. | 91/417 R X |
| 3,691,907 | 9/1972 | Paschke | 91/321 |
| 3,998,132 | 12/1976 | Rasigade | 91/395 |
| 4,240,329 | 12/1980 | Inhofer et al. | 91/342 |
| 4,296,672 | 10/1981 | Inhofer | 91/271 |
| 4,389,153 | 6/1983 | Pedersen et al. | 414/695.5 |
| 4,404,892 | 9/1983 | Nakamura et al. | 91/396 |
| 4,432,578 | 2/1984 | Garlinghouse | 91/417 R X |
| 4,465,497 | 8/1984 | Howeth | 91/417 R X |
| 4,585,172 | 4/1986 | Gazzera | 91/417 R X |
| 4,708,053 | 11/1987 | Forsythe et al. | 91/335 X |

FOREIGN PATENT DOCUMENTS

| | | | |
|---|---|---|---|
| 2459210 | 6/1976 | Fed. Rep. of Germany | 91/321 |
| 50741 | 3/1910 | Switzerland | 91/342 |

*Primary Examiner*—Robert E. Garrett
*Assistant Examiner*—Mark A. Williamson
*Attorney, Agent, or Firm*—James L. Jackson

[57] ABSTRACT

A fluid energized double acting motor is provided for use as the drive for reciprocating mechanisms such as paint pumps for airless spray painting. A piston within the pump housing is moved by pressurized fluid controlled by an automatic reversing valve including spaced check valves. The check valves are selectively seated and unseated by a spring biased piston and fluid pressure controlled valve actuator assembly. The reversing valve system includes anti-stalling features and is of single, low cost, field repairable nature. The motor system also includes features to prevent chattering oscillation due to abrupt changes in motor load.

27 Claims, 2 Drawing Sheets

AUTOMATIC REVERSING VALVE

This is a continuation of Application Ser. No. 06/909,594 filed on Sept. 17, 1986 now abandoned. which Application Ser. No. 06/909,594 was a continuation-in-part of Application Ser. No. 06/776,562 of Philip L. Cowan, filed on Sept. 16, 1985 and entitled AUTOMATIC REVERSING VALVE.

FIELD OF THE INVENTION

This invention relates generally to the design of a simple, inexpensive and reliable fluid energized double acting motor having an automatic reversing valve for imparting reciprocating movement and control to the power output shaft of the motor. The apparatus is basically in the form of a reciprocating pneumatic or hydraulic cylinder motor.

Similar motors have been conceived in the past, as evidenced by U.S. Pat. Nos. 4,240,329 of Inhofer, et al. 3,691,907 of Paschke and 3,183,788 of Olsson, but have never found successful application in, for example, the painting industry. Their lack of acceptance is due to the fact that the detenting action of the reversing valve is achieved by the fluid operating pressure acting on one of the two spaced check valves. The action of a reciprocating motor connected to a reciprocating paint pump is such that rapid system flow changes and pressure drops can occur under certain operating conditions and these pressure and flow changes cause severe instabilities in the reversing valve. This invention relates specifically to an improvement which controls the fluid pressure on the reversing valve at all times to eliminate any such instabilities and ensure stable operation.

More specifically the invention concerns the provision of a double acting reciprocating fluid energized motor of simple, reliable low cost nature which finds effective use in various reciprocating devices.

Fluid energized double acting reciprocating motors are in current use for imparting power and control to many reciprocating mechanical devices, such as pumps for airless spray painting. Most reversing valves for double acting fluid motors of this nature are constructed with close fitting moving parts which frequently have lapped or other high tolerance machined interfitting surfaces thereby causing such motors to be of very expensive manufacture. Further, because of the close fitting relation of the parts, servicing of such motors becomes a problem due to expense of the parts. Also, most fluid motors of this nature have a significantly large number of moving parts and require high quality manufacturing facilities with high precision machinery for their manufacture. The resulting fluid motors are typically of large size which limits their effective use in small sized equipment.

It is desirable, therefore, to provide an inexpensive and stable double acting fluid energized motor which is of small size and may be efficiently manufactured in widely available manufacturing facilities equipped with ordinary machine tools. It is also desirable to provide double acting motors which are easily field repairable, thus minimizing down time of associated equipment.

SUMMARY OF THE INVENTION

It is therefore a primary feature of this invention to provide a stable fluid energized double acting motor providing for very internal low leakage without the requirement for precision grinding and fitting of sliding motor components.

It is another feature of this invention to provide an improved fluid energized double acting motor incorporating a simple, low cost and efficient internal reversing valve mechanism that may be efficiently repaired in the field to minimize down time of motor energized equipment should such repair become necessary.

It is also a feature of this invention to provide a double acting fluid energized motor which will not stall and which will not chatter or oscillate when abrupt load changes occur.

Briefly, the fluid energized motor of this invention is formed by a housing, the inner chamber of which is provided with a piston capable of being driven in either direction by pressurized fluid. The piston includes an extension passing through a wall of the housing for connection to a double acting paint pump or other load. Reciprocating movement of the piston and thus the load is controlled by an internal reversing valve mechanism having spaced check valves and means for shifting the reversing valve mechanism responsive to the position of the piston and the pressure of the operating fluid. The reversing valve mechanism is of simple, low cost design and is field replaceable as are the other internal components of the motor. Features are incorporated maintain adequate sealing pressure on the valve to ensure that the motor cannot stall at an inoperative position and to further ensure against chattering or oscillation responsive to sudden variations in load.

BRIEF DESCRIPTION OF THE DRAWINGS

In order that the manner in which the above recited advantages and features of this invention are attained and can be understood in detail, more particular description of the invention briefly summarized above may be had by reference to the specific embodiments thereof that are illustrated in the appended drawings, which drawings form a part of this specification. It is to be understood, however, that the appended drawings illustrate only typical embodiments of the invention and are, therefore, not to be considered limiting of its scope, for the invention may admit to other equally effective embodiments.

In the Drawings

DETAILED DESCRIPTION OF PREFERRED EMBODIMENT

Figure 1:
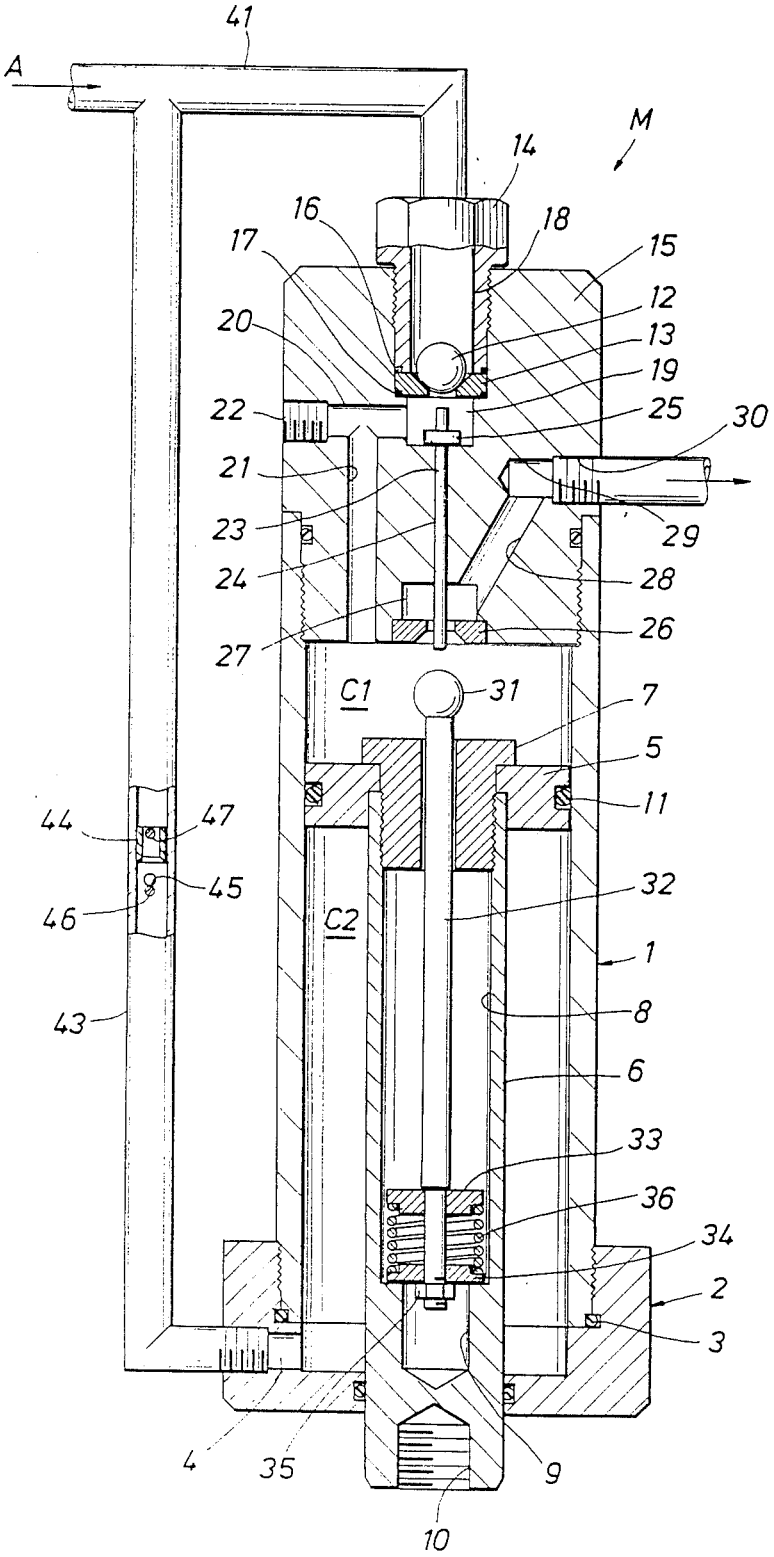
FIG. 1 is a sectional view of a double acting fluid energized motor of this invention, illustrating the motor mechanism in the upstroke and representing the preferred embodiment.
Figure 3:
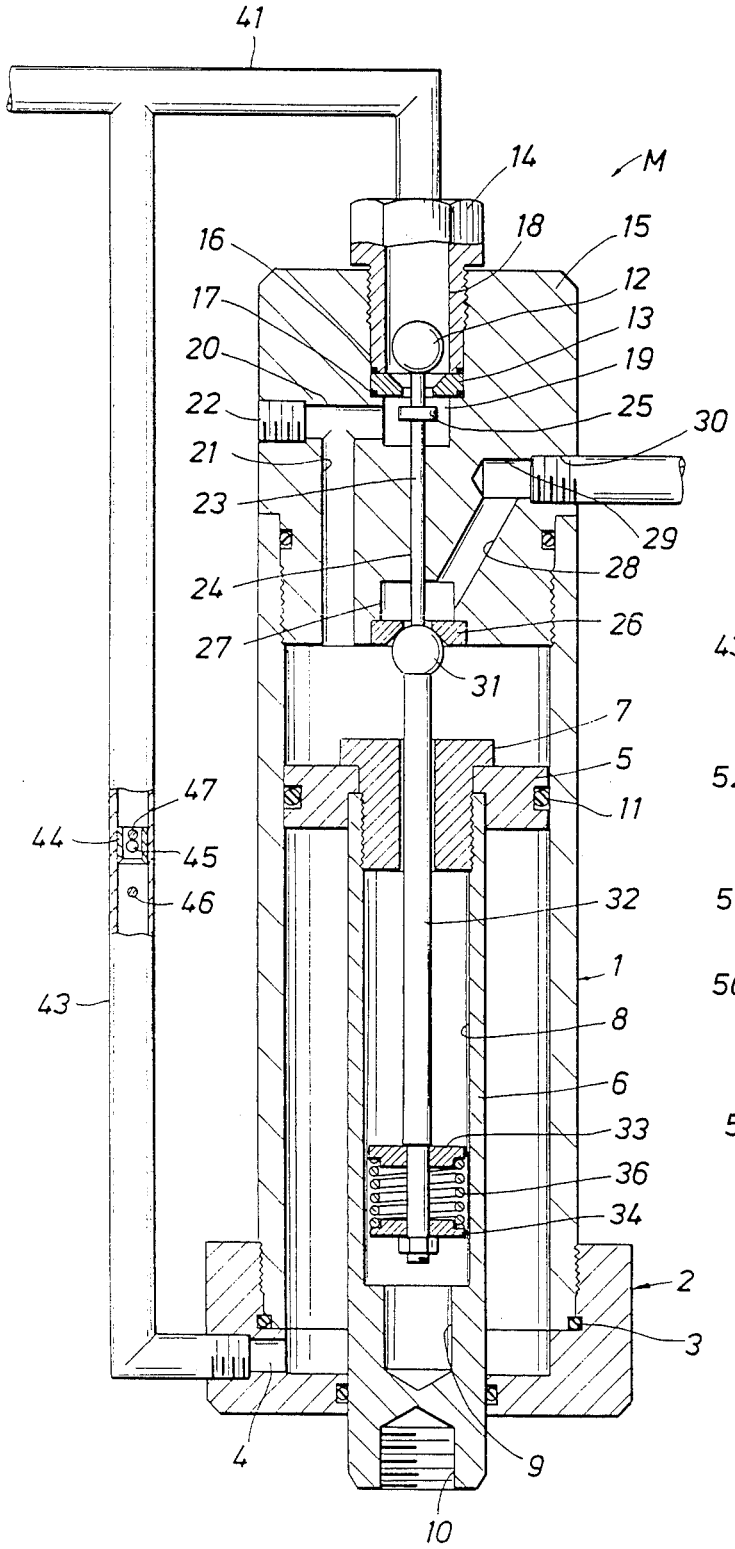
FIG. 3 is a sectional view illustrating the double acting fluid energized motor of FIG. 1 on the downstroke.

Referring now to the drawings and first to FIGS. 1 and 3 a fluid energized double acting motor, also referred to herein as a "cylinder", is illustrated generally at M. The motor M incorporates a reciprocating piston and operating shaft which are controlled by a reversing valve assembly which is shown schematically in FIGS. 1 and 3.

The construction and operation are described as follows.

The fluid motor assembly includes a housing having a valve head 15 and cylinder 1. The cylinder is formed of tubular material threaded internally at its upper portion and externally at the lower portion.

The housing assembly further includes a base shown generally at 2 which is internally threaded to receive the lower end of the cylinder 1 and is sealed with respect to the cylinder by an O-ring seal 3. The cylinder forms an internal chamber which is partitioned by the piston into an upper chamber C1 and a lower chamber C2 on respective upper and lower sides of the piston. The piston 5 is maintained in sealed relation with the cylinder walls by an O-ring 11.

A fluid supply port 4 is drilled and tapped in the side of the base 2 to permit oil flow in and out of the second chamber C2 located below the piston 5.

The piston 5 includes a lower piston extension 6 of tubular form which is fastened to the piston 5 by a retainer nut 7 threaded into the internal threads at the upper portion of the piston extension 6. The piston extension is drilled or otherwise formed internally with a large bore 8 and a smaller bore 9. The lower end of the piston extension shaft 6 is threaded internally at 10 for attachment to the load.

For applications requiring equal delivered force to the load on both the upward and downward stroke, the piston rod 6 should be sized so that its cross sectional area normal to the direction of motion is one-half of the internal area of the cylinder 11. Fluid from a supply under pressure is supplied through conduit A and is connected to the region C2 below the piston through conduit 43 and passage 4. One embodiment of a flow control valve is included in conduit 43 and will be described later.

Movement of the piston within the cylinder 1 is controlled by a reversing valve assembly incorporating upper and lower check valves. The upper check valve is formed in the valve head by a free floating ball check 12 capable of being seated in a conical seat 13. The seat is retained in place by a plug 14 which is threaded into the upper portion of the valve head 15. The seat 13 and plug 14 are sealed by O-rings 16 and 17.

The plug 14 defines an in internal bore 18 which is internally threaded or otherwise configured at its upper portion to accept the fluid supply fitting of supply conduit 41.

A bore 19 below the seat 13 allows oil or other fluid medium flowing through the seat 13 to communicate with fluid supply passages 20 and 21 into the upper chamber region in the cylinder above the piston. A plug 22 screws into the outer end of bore 20 to plug it after drilling.

A free floating shifter rod 23 is positioned for reciprocating movement within a bore 24 formed in the valve head 15 below the check valve 13. The shifter rod is supported against further downward movement in the position of FIG. 3 by a shoulder 25 which rests on the bottom of bore 19. The upper end of the shifter rod rests below the ball check 12 in the upper seat.

A lower check valve seat 26 is mounted in the bottom of the valve head 15 and is held in place y soldering or adhesive or by other suitable means of attachment. A bore 27 above the lower seat connects with passages 28 and 29 to a threaded exhaust port 30.

A ball check 31 which seats in the lower check valve seat is fastened securely (welded) to the upper end of the trip rod assembly 32. The lower end of the trip rod 32 is reduced in diameter to accept two sliding actuators 33 and 34 separated by a compression spring 36. The lower end of the trip rod is threaded to accept a locknut 35 which holds the spring and actuators in place. With the valve in the position shown in FIG. 1, the pressurized actuating fluid will enter the second chamber through port 4 and exert a force on the piston causing it to move upwardly. The fluid above the piston in the first chamber C1 will exhaust through bores 27, 28, and 29 back to the supply reservoir where it is again pressurized for recirculation in the motor system.

As the piston continues its upward movement the lower ball 31 will contact the lower end of the shifter rod 23. The shifter rod is of such length that the ball check 31 will contact the shifter rod before reaching the seat 26. The shifter rod 23 will be moved upwardly by the ball 31 and will contact the lower portion of ball 12 before ball 31 reaches the seat 26. The shifter rod will be restrained under this condition from moving upward, by the force developed by the pressure of the incoming fluid on the upper ball check 12. As the piston continues its upward movement, a lower actuator 34 will be supported by the internal shoulder of the piston extension and thus the lower end of the rod 32 will slide through the lower actuator 34 and into the small bore 9 compressing the spring 36.

When the compressive force on the spring 36 exceeds the pressure induced force holding ball 12 in sealed relation with seat 13 unseating of the ball check will occur and the rod 32 will move upward rapidly and seat the lower ball 31 in the seat 26. With the reversing valve assembly in this shifted position the fluid from the supply will enter the region C1 above the piston 5 and because of its larger area than the lower face of the piston, the piston will reverse direction and the force of pressure above the piston, in the first chamber C1, will hold the ball 31 in the seat 26 and the ball 12 off the seat 13.

As the piston coves downward, the rod assembly 32 will stay fixed in the upper position with the lower ball 31 in its seat, held by the pressure in the region C1 above the piston 5.

When the piston nears the bottom of the stroke the upper actuator 33 contacts the bottom of the piston retaining nut and the upper actuator 33 will slide down on the rod 32 compressing the spring 36. When the compressive force on the spring equals the force of the pressure holding the ball 31 in the seat 26 the spring 36 enacting through the trip rod 32 will pull the ball 31 free of the lower seat. The shifter rod 23 will then drop down to the FIG. 3 position, allowing the upper ball 12 to drop into sealing contact with the seat 13 thus shutting off the incoming oil flow to the region C1 above the piston, reversing the direction of the piston.

The fluid motor mechanism as described above operates well over a wide range of conditions, but is subject to some considerations which limit its use without further improvements which are the subjects of this invention.

A hydraulic motor such as that shown in FIG. 1, operating at elevated pressures, requires a relatively strong spring to overcome the seating forces on the check balls at the end of each stroke. It is possible, and this will occur very occasionally when the device is shut down, that the piston will coast to a stop in such a position that the upper ball 12 is removed from its seat but the lower ball 31 is not yet seated. The incoming fluid will exert a down ward force on the valve ball 12 but if this force is insufficient to compress the spring 36 enough to displace the shifter rod and seat the ball 12 the motor will stall and physical displacement of the piston rod 10 will be required to resume operation.

Stalling of the fluid motor under this circumstance can be overcome by providing a spring force having a non-linear spring force constant. This can be accomplished by a single spring with a non-linear spring force constant or by two or more springs working in series or parallel. One suitable embodiment incorporating dual springs may take the following form.

It has been determined that the provision of an embodiment incorporating a second spring softer and slightly longer than the spring 36 can eliminate this problem by providing a low magnitude, soft spring force on the reversing valves system which becomes effective before the piston reaches the limit of its upward movement. The dual spring configuration shown in FIG. 2 may be substituted for the spring and sliding actuator assembly of FIG. 1. The trip rod 32' is basically the same as trip rod 32, but the sliding spring retainers 33' and 34' secured by lock nut 35' have been modified to retain two compression springs 36' and 37. The inner spring 36' operates in the same fashion as spring 36 of FIG. 3 to effect shifting under normal operating conditions. The spring 37 is softer and longer than spring 36', hence it becomes effective before the inner, stiffer, spring and positively influences valve shiftover.

Figure 2:
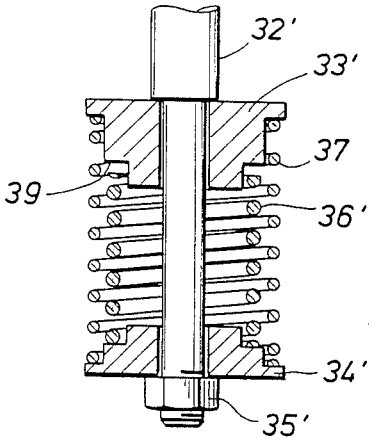
FIG. 2 is a fragmentary sectional view of the fluid energized motor mechanism of FIG. 1, illustrating an alternative anti-stalling spring system.

In the configuration shown in FIG. 2, the spring 37 is in contact with the two sliding retainers 33' and 34' and maintains them in the fully separated position in mid stroke of the fluid motor the separation being greater than that caused by spring 36'. The spring 37 must be compressed a distance at least equal to the travel of the ball check members 12 and 31 during shiftover before the upper end of spring 36' comes into contact with bearing surface 39 of the upper collar 33'.

In the event that the piston coasts to a stop at or near the top of its stroke, the stalling problem is eliminated and the device will start up when full flow is initiated. Before the stronger spring 36' comes into play in the shifting process, The spring 37 will lift the ball 31 into its seating position. In the event that the piston stops with spring 37 supporting the trip rod and with the ball check members 31 and 12 both unseated, initiation of a full flow will exert a downward force on ball 12 and overcome the force of spring 37 to force the upper ball to its seat, and resume operation. The spring 37 therefore must be strong enough to support the weight of the trip rod assembly but insufficiently strong to maintain the upper ball 12 in the open position against the normal minimum operating fluid flow. It has been found in practice that this is relatively easy to accomplish.

It has been found further that the subject invention when used, for example, to power a double acting fluid piston pump, requires further refinement to avoid operational problems.

If a double acting piston displacement pump, as for example those used in airless painting, is connected to the threaded adapter 10 on the end of the piston rod 6 the subject invention could provide a lower cost reciprocating motor much simpler than those in commercial use.

Under normal operating conditions of an airless giant pump, the force of the load is such as to oppose the motion of the piston in the hydraulic motor. Under certain conditions, however, particularly when the paint pump is running out of fluid, it can exert very strong downward forces on the oil motor piston. On the "up" stroke these downward forces cause no problem but on the "down" stroke these external forces can cause instabilities as will be described with reference to FIG. 3.

In FIG. 3, which depicts the moor of FIG. 1 operating on the downstroke, it can be seen that the fluid will flow through conduits 18 20 and 21 into the region C1 above the piston. The fluid from the region C2 below the piston will flow from the motor through passage 4 and conduit 43 to join the incoming supply fluid flowing into the region C1 above the piston. In the motor described, the flow from the region C2 below the piston and the flow from the fluid source will be equal since the area above the piston is twice the area below.

Under certain conditions, as described earlier, the external load can place a strong downward force on the piston rod. This downward force can cause the piston to move faster on the downstroke than its normal maximum operating speed as determined by the delivery from the fluid supply pump. When this happens, the reversing valve becomes unstable, as will be described below.

With the piston 5 moving downward at higher than maximum operating speed, the fluid flow from region C2 below the piston is increased and it flows to the region C1 above the piston. This flow however, is only half of the flow required to fill the volume above the piston. Since the flow from the supply cannot simultaneously increase, the total fluid flow into the region C1 above the piston will be insufficient to fill the rapidly increasing volume and the pressure above the piston will drop and can even cause cavitation. This rapid pressure drop and the associated fluid friction on the trip rod assembly, generally designated 32, will cause t he lower ball 31 to unseat and the valve will shift causing the position of the motor to move upward again. The result is a rapid oscillation at the top of the stroke which can only be stopped by reducing the pressure on the paint pump to reduce or eliminate the downward forces on the piston rod. This type of instability would render the device unsuitable for use in some applications. A key and necessary part of this invention is the provision of a means to control this instability.

It has been found that a fluid control valve in conduit 43 can provide the control required. The flow control valve consists of a ball 45 which is free to move inside the fluid conduit. It is restrained in its downward travel by a transverse pin 46. The ball is significantly smaller than the inside diameter of conduit 43 and when the fluid flow is downward in conduit 43 (upstroke) a full flow of fluid is enabled around the ball. When the fluid flow in conduit 43 reverses (downstroke) the ball 45 is moved by the fluid into a reduced area defined by conduit 44 and is restrained from moving further upward by a transverse pin 47.

The diameter of the bore 44 is sized so as to restrict the flow of oil past the ball. It is evident that the restriction of the fluid flow upwards in conduit 43 will cause a pressure build-up in chamber C2 below the piston 5 and will limit the rate at which the external downward forces can move the piston 5 downwardly. It has been found that it is relatively simple, for any given fluid supply flow and maximum external force, to size the ball 45 of conduit 44 so as to limit the maximum speed at which the external forces can move the piston to less than the maximum normal operating speed. All instabilities can thus be eliminated.

It will be evident to one skilled in the art that a simple orifice in conduit 43 would achieve the same result but would result in less efficient operation and more heat build-up because the pressure drop would occur on both strokes of the device. Where efficiency and heating are not considered limitations, an appropriately sized restrictive orifice in conduit 43 would be a preferred embodiment of the invention.

The valve as described above is effective in controlling the instability when the fluid supply flow and maximum external forces are relatively constant. In many applications, however, as for example when the power source is an internal combustion engine, the fluid supply flow can vary widely as the engine speed is varied. The external forces will not generally be dependent on the operating speed and it may therefore be necessary to change the restriction in conduit 43 as the fluid supply flow varies with more restriction required at low speed and less at high speed.

Figure 4:
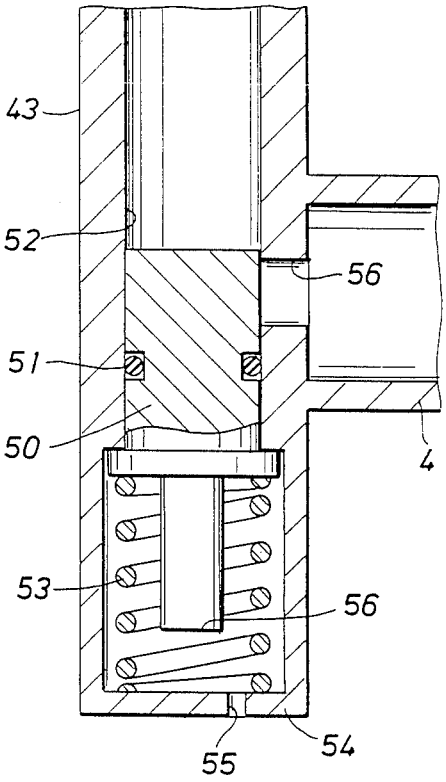
FIG. 4 is a fragmentary sectional view of a control valve for accommodating wide variations in speed and/or external forces.

In applications where there are wide variations in speed and/or external forces, a different type of control valve can be considered in conduit 42. This type of valve is shown generally in FIG. 4 and would be located at the junction of conduit 4 and conduit 43 in FIG. 3.

The valve consists of a piston generally designated 50 which is movably positioned in the inner bore 52 of conduit 43 by an orifice 56 which is sufficiently large to permit unobstructed oil flow up to the maximum volume required for operation of the motor. The piston 50, in the position shown, blocks off the orifice 56 and prevents flow from conduit 4 to conduit 43. The piston 50 is held in position by a precompressed spring 53 which is retained at its lower end by a cap 54. The piston 50 is sealed in bore 52 by an O-ring 51. The region below the O-ring is vented to the atmosphere by a hole 55 in the end cap 54. The spring 53 is precompressed and adjusted so as to require a minimum positive pressure in conduit 43 before it will compress further and open orifice 56 for fluid flow.

The operation of the valve is as follows. When the motor is turned on and is operating normally, the system fluid pressure will cause spring 53 to compress and the piston 50 to move downward opening orifice 56 and allowing full oil flow. In the event, as described earlier, that the external downward forces on the piston on the downstroke cause a drop in pressure above the piston and hence in conduits 41 and 43, the spring 56 will move piston 50 upwards, thus restricting the flow out of conduit 4 and limiting the downward speed of the piston 5 in the cylinder of the oil motor. The precompression of spring 53 is adjusted so that it will close off orifice 56 before the pressure in conduit 43 and hence in 41 and above the piston is low enough to cause unseating of ball 31 in seat 26.

This type of valve ensures stable operation over widely varying conditions of external load and fluid flow rates. It further offers little restriction of the oil flow under normal operating conditions and comes into play only when required to prevent unstable operation under "unusual" load conditions. The valve does give rise to some inefficiency and heating when operating under "no load" conditions since a minimum system pressure is required to maintain orifice 56 fully open. The no load operation is, however, relatively unimportant for heating and efficiently considerations.

It will be evident to one skilled in the art that the improvements described herein can be used to prevent stalling in more conventional oil motors as well.

It will be apparent to one skilled in the art that there are many alternative ways in which such flow restricting valves can be constructed without departing from spirit and the scope of this invention.

While the foregoing is directed to the preferred embodiment of the present invention, other and further embodiments of the invention may be devised without departing from the basic scope thereof, and the scope thereof is determined by the claims which follow.

I claim:

1. A fluid energized double acting motor, comprising:

(a) housing means forming an internal chamber;

(b) piston means being disposed for reciprocation within said internal chamber and having a load operating extension movable in sealed relation through a wall of said housing for connection to a load, said piston means dividing said internal chamber into first and second chambers and presenting differing piston areas to said first and second chambers;

(c) fluid supply means being in communication with said first and second chambers;

(d) exhaust means in communication with said first chamber;

(e) reversing valve means being positionable to block the flow of fluid from said fluid supply means to said first chamber, to communicate said exhaust means with said first chamber and to permit the flow of fluid from said fluid supply means to said second chamber for fluid pressure induced movement of said piston and load operating extension in one direction, said reversing valve means being oppositely positionable to block communication of said first chamber and said exhaust means and permit simultaneous communication of said fluid supply means with said first and second chambers for movement of said piston and load operating extension in the opposite direction, said reversing valve means being maintained at each blocking position thereof by the pressure of said fluid supply means;

(f) valve operator means being operative to shift said reversing valve means between the blocking positions thereof and including means developing a shifting force on said reversing valve means increasing with piston movement until said shifting force overcomes pressure induced force acting on said reversing valve means and suddenly shifts said reversing valve means to the opposite blocking position thereof; and (g) driving fluid restriction means retarding initial load induced piston movement in said opposite direction to a sufficient extent permitting positive shifting and seating of said reversing valve by said shifting force developing means, thus preventing stalling and short cycling of said motor.

2. A fluid energized double acting motor as recited in claim 1, wherein said driving fluid restricting means comprises means restricting fluid flow from said second chamber means.

3. A fluid energized double acting motor as recited in claim 1, including a spring being interactive with said valve operator means and said piston means for compression thereof during fluid pressure induced movement of said piston means.

4. A fluid energized double acting motor as recited in claim 3, wherein said urging means comprises spring means providing a non-linear compression characteristic inducing a low spring force constant at initial contact with said reversing valve means and providing a greater spring force constant upon further movement of said piston toward said reversing valve means.

5. A fluid energized double acting motor as recited in claim 1, including:

(a) a pair of spring stops being disposed in spaced relation; and (b) said shifting force developing means engages one of said spring stops near the end of piston movement in each direction thus translating piston movement into valve shifting force.

6. A fluid energized double acting motor as recited in claim 5, wherein:

(a) valve trip means extends through said piston means and between said stop means; and (b) urging means is interactive between said valve trip means and is compressible upon movement of said valve trip means with said urging means restrained by said stop means.

7. A fluid energized double acting motor as recited in claim 1, wherein said reversing valve means comprises:

(a) a first valve seat through which said fluid flows from said fluid supply means to said first chamber;

(b) a second valve seat through which said fluid flows from said first chamber to said exhaust means;

(c) first and second check valve elements being movable to and from seating engagement respectively with said first and second valve seats; and (d) said valve operator means controlling seating and unseating of said check valve elements responsive to piston movement and the pressure of said fluid.

8. A fluid energized double acting motor as recited in claim 7, wherein:

(a) said first check valve element is a free floating ball check;

(b) said second check valve element is a ball check; and (c) said valve operator means induces seating and unseating movement of said free floating ball check and seating and unseating movement of said second ball check.

9. A fluid energized double acting motor as recited in claim 7, wherein:

(a) a pair of spring stops are located within said housing means and are disposed in spaced relation;

(b) an elongated trip rod is interconnected at one extremity thereof with said second check valve element; and (c) spring means is positioned between said spring stops and engages respective spring stops near the opposed limits of piston travel thus inducing said shifting force to the closed one of said first and second check valve elements.

10. A fluid energized double acting motor as recited in claim 9, wherein valve shifter means is interposed between said first and second check valve elements and transmits said shifting force from said second check valve element to said first check valve element.

11. A fluid energized double acting motor as recited in claim 10, wherein said valve shifter means is an elongated shifter rod disposed for reciprocating movement within said housing means and has a length sufficient to prevent simultaneous seating of said first and second check valve elements.

12. A fluid energized double acting motor as recited in claim 1, wherein:

(a) a pair of spring stops are located within said housing means and are disposed in spaced relation;

(b) a compression spring is positioned between said spring stops; and (c) a pair of actuator elements are positioned at opposed ends of said compression spring, respective spring stops are engaged by respective actuator elements as said piston means nears respective limits of its travel, thus causing said compression spring to induce said shifting force to said valve operator means.

13. A fluid energized double acting motor as recited in claim 1, wherein:

(a) said fluid supply means defines fluid supply passage means having a flow port; and (b) pressure responsive flow control means permitting unobstructed flow of fluid through said flow port when fluid supply pressure between said flow port and said first chamber means is above a predetermined minimum and restricting the flow of fluid through said flow port when fluid supply pressure between said flow port and said first chamber means is below said predetermined minimum.

14. A fluid energized double acting motor as recited in claim 1, wherein:

(a) said fluid supply means includes supply passage means communicating directly with said second chamber and communicating through said reversing valve means with said first chamber; and (b) restriction means is disposed in said flow passage means between the connections thereof with said first and second chambers for restricting outflow from said second chamber.

15. A fluid energized double acting motor as recited in claim 14, wherein said restriction means provides for freer fluid flow into said second chamber than from said second chamber.

16. The improvement of claim 14, wherein said reversing valve means comprises:

(a) first check valve means being a free floating check valve; and (b) second check valve means being supported by said valve operator means and being movable to and from its seated position by said valve operator means.

17. The apparatus of claim 1, wherein:

(a) said fluid passage means defines an internal flow port of a dimension permitting unobstructed flow of fluid to the maximum volume required for operation of said fluid energized double acting motor; and (b) valve means is movably disposed within said fluid passage means and is movable to a restricting position restricting flow of fluid through said flow port and to an open position permitting flow of fluid through said flow port, said valve means being moved to said open position responsive to a minimum positive fluid pressure within said fluid passage between said valve and said fluid supply means and being automatically moved to said restricting position when fluid pressure within said fluid passage means between said valve and said fluid supply is less than said minimum positive pressure.

18. The apparatus of claim 17, wherein:

spring means urges said valve means toward said closed position.

19. The apparatus of claim 1, wherein:

(a) said fluid supply means defines a fluid supply passage receiving pressurized fluid and being in communication with said first and second chambers, said fluid supply passage forming a flow port; and (b) pressure responsive means being disposed in flow controlling relation with said fluid passage means, said pressure responsive means permitting unobstructed flow of fluid through said flow port responsive to the presence of at least a minimum positive fluid pressure within said fluid passage means between said flow port and said first chamber means and automatically restricting the flow of fluid through said flow port when fluid pressure within said fluid passage means between said flow port and said first chamber means is less than said minimum positive pressure.

20. In a fluid energized double acting reciprocating motor having a housing defining a cylinder and a piston dividing said cylinder into first and second chambers said piston presenting greater piston surface area to said first chamber than to said second chamber and including a load operated extension movable in sealed relation through a wall of said housing and being subject to application of external loads thereto, the improvement being a reversing valve mechanism comprising:

(a) fluid supply passage means delivering pressurized actuating fluid from a supply to said first and second chambers;

(b) exhaust passage means being communicated with said first chamber;

(c) reversing valve means being movable to a first position exhausting operating fluid from said first chamber and being movable to a second position closing said exhaust and permitting introduction of pressurized operating fluid from said supply into said first chamber said reversing valve means being so positionable during valve reversal as to communicate said first chamber and said supply passage means with said exhaust passage means;

(d) valve operator means being responsive to piston movement for automatically shifting said valve means between said first and second positions at the end of each piston stroke; and (e) said supply passage means being restricted sufficiently to retard the exhaust rate of fluid flow from said second chamber thus retarding load induced movement of said piston during shifting of said reversing valve to an extent permitting and maintaining positive shifting of said reversing valve by said valve operator means.

21. The apparatus of claim 20, wherein:

(a) said fluid supply passage means defines a fluid supply passage receiving pressurized fluid and being in communication with said first and second chambers; and (b) pressure responsive means being disposed in flow controlling relation with said fluid passage means, said pressure responsive means permitting unobstructed flow of fluid through said flow port responsive to the presence of at least a minimum positive fluid pressure within said fluid passage means between said flow port and said first chamber means and automatically restricting the flow of fluid through said flow port when fluid pressure within said fluid passage means between said flow port and said first chamber means is less than said minimum positive pressure.

22. The improvement of claim 20, wherein said pressure responsive means is defined by a valve element movably positionable relative to said flow port.

23. The improvement of claim 20, wherein said reversing valve means includes first and second check valve means disposed in spaced independently actuatable relation.

24. The improvement of claim 23, wherein valve shifter means is interposed between said first and second check valve means and prevents simultaneous seating of said first and second check valve means, said valve shifter means is moved by said second check valve means for unseating of said first check valve means.

25. The improvement of claim 24, wherein said valve operator means includes:

(a) an elongated trip rod having said second check valve means at one end thereof;

(b) a pair of spring stops being located within said housing and are disposed in spaced relation; and (c) spring means being positioned between said spring stops and being compressed by respective ones of said spring stops upon movement of said piston to respective ends of its travel, thus increasing unseating force on the closed check valve means until the unseating force overcomes the pressure induced seating force thereof and said check valve means opens, causing the direction of piston motion to be reversed.

26. A double acting reversing oil motor comprising:

(a) housing means forming an internal chamber;

(b) a piston adapted for connection to a load being movably positioned within said internal chamber and partitioning said internal chamber into first and second motor chambers, said piston presenting a larger surface area to said first motor chamber than said second motor chamber;

(c) fluid supply passage means interconnecting said first and second motor chamber means and being in communication with a source of pressurized operating fluid, said fluid supply passage means defining a flow port of sufficient dimension to permit the maximum rate of fluid flow necessary for operation of said reversing oil motor;

(d) reversing valve means shifting the direction of flow within said fluid supply passage at each end of the stroke of said piston;

(e) restricting valve means restricting flow of fluid within said fluid supply passage means when pressure between said reversing valve means and said second motor chamber is below a predetermined minimum, said restricting valve means being at a position permitting unobstructed flow of fluid through said flow port responsive to the presence of a predetermined minimum fluid pressure between said reversing valve means and said second motor chamber and being at positions restricting flow of fluid through said flow port responsive to fluid pressure between said reversing valve means and said second motor chamber that is below said predetermined minimum fluid pressure; and (f) spring means urging said restricting valve means toward said position restricting flow of fluid through said flow port, said spring means having a preload force that is overcome by said predetermined minimum fluid pressure.

27. A double acting reversing oil motor as recited in claim 26, wherein:

said restricting valve means is sealed with respect to said fluid supply passage and is at atmospheric pressure on one side thereof and at fluid supply pressure on the opposite side thereof resulting in development of a pressure differential urging said restricting valve means against said preload force.

* * * * *